United States Patent [19]

Heinemann

[11] 4,224,370

[45] Sep. 23, 1980

[54] TRANSVERSE STIFFENED SCREEN PRINTING BLANKET

[75] Inventor: Frederick E. Heinemann, Canton, Mass.

[73] Assignee: W. R. Grace & Co., Cambridge, Mass.

[21] Appl. No.: 871,734

[22] Filed: Jan. 23, 1978

[51] Int. Cl.[2] ..... B41N 9/00

[52] U.S. Cl. ..... 428/246; 428/250; 428/252; 428/257; 428/295; 428/364; 428/909

[58] Field of Search ..... 428/246, 257, 258, 259, 428/292, 293, 294, 295, 364, 908, 909, 222, 105, 107, 250, 252

[56] References Cited

U.S. PATENT DOCUMENTS

| | | | |
|---|---|---|---|
| 2,804,417 | 8/1957 | Cross et al. | 428/909 |
| 3,047,446 | 7/1962 | Henson | 428/222 |
| 3,122,934 | 3/1964 | Fihe | 428/222 |
| 3,146,155 | 8/1964 | Tremner | 428/222 |
| 3,235,772 | 2/1966 | Gurin | 428/909 |
| 3,418,864 | 12/1968 | Ross | 428/909 |
| 3,565,741 | 2/1971 | Jaray | 428/294 |
| 3,622,429 | 11/1971 | Kuppan | 428/294 |
| 3,673,023 | 6/1972 | Ross | 428/222 |
| 3,755,054 | 8/1973 | Medney | 428/112 |
| 3,941,005 | 3/1976 | Gardiner et al. | 74/233 |
| 3,983,282 | 9/1976 | Seemann | 428/294 |
| 4,061,818 | 12/1977 | Duckett et al. | 428/909 |
| 4,110,505 | 8/1978 | Prewo | 428/294 |

*Primary Examiner*—James J. Bell

*Attorney, Agent, or Firm*—Edward J. Hanson, Jr.; C. Edward Parker

[57] ABSTRACT

A screen printing blanket having two transverse stiffening plys of polyester rods spaced fron one another across the neutral plane. The rods are preferably monofilaments of polyethylene terephthalate. For less desirable practicing of the invention only one layer of the preferred rods need be used and in other embodiments other rod materials may be used and in yet other embodiments the invention may be extended to two spaced plys not bridging the neutral plane and even to non-printing blanket belts.

12 Claims, 2 Drawing Figures

TRANSVERSE STIFFENED SCREEN PRINTING BLANKET

BACKGROUND OF THE INVENTION

This invention relates to printing blankets and especially to blankets that are continuous belts adapted for use on screen print machines.

Printing blankets used on screen print machinery are very large, and are enormously heavy. Frequently they are some 100 inches wide, and 100 yards long. Such blankets are formed in a closed loop. The material which is to be screened printed is glued to the blanket, and as each color step is imprinted on the goods, the blanket is advanced through one "repeat pattern". As a consequence, the entire blanket must start, move, and stop with an extraordinary degree of exactitude. If the variation in an entire traverse of the loop at any point exceeds 4 thousandths (0.004) of an inch, inferior printing will occur. If the amount of displacement as the blanket advances through one repeat pattern is greater than or less than in the preceding step, the pattern will not "fit".

This is serious, for "fit" in the textile printing sense means that each color, as it is successively applied, has been placed in the exact position required by the design. When fit is poor, some color margins overlap, the printed design on the finished goods appears "mushy", and sometimes unpleasant color mixing results. Poor fit results in severe economic loss, for the printed goods can then only be sold at sacrifice prices.

The blanket is generally engaged over and extends between two opposed rolls for the screen printing operation. One of the rolls is driven and drives the blanket through frictional engagement. The other roll is an idler roll. There are other commonly used methods of driving the blanket such as through the use of side clamps. The blanket is frequently guided by being engaged on its sides by opposing collar guides mounted on idler rolls. Even more abusive guides are sometimes used which do not rotate with the passing of the blanket but scrape against the blanket edges. It is necessary for the blanket to have a high degree of cross machine direction stiffness for these guides to work, a belt that is limp transversely will tend to buckle or bend during use when in contact with these guides and consequently will not align or track properly. Another reason requiring a blanket to have high transverse stiffness is the provision of sufficient stiffness to prevent the blanket's bending in the cross machine direction due to the contracting forces caused by the shrinkage of the fabric being printed when the fabric goes from dry to wet to dry during various printing stages.

So far as I am aware, transverse stiffness against transverse collapse, folding or distortion of printing blankets has in the past been achieved by providing thickness in the blanket. This thickness has many obvious disadvantages such as increasing the blanket's weight, depending on materials chosen increasing the blanket's cost and causing creping (wrinkling) in the material glued on the blanket if the blanket goes around a roll without first having the material removed.

By the present invention transverse stiffness against transverse collapse, folding or distortion has been provided in an expeditious way providing many improvements and also providing an enhanced ability to have good transverse stiffness in thinner blankets. Even in thicker blankets the blanket performance and life would in many instances be significantly improved by use of the present invention.

An excellent screen printing blanket is taught in U.S. Pat. No. 3,418,864, the contents of which are incorporated herein by reference. The manufacturing process taught therein is suitable for manufacturing the present preferred blanket with the exception that two spaced apart woven plys are those of the present invention containing the transverse rods. In addition in its preferred form the number of plys will also be reduced.

SUMMARY OF THE INVENTION

In its most preferred embodiment the invention is represented by screen printing blanket that is a continuous belt consisting essentially of a cylinder ply, that is the first fabric ply and a transverse stiffening ply. The cylinder ply includes a plurality of transverse rods. A rubber layer containing a cord ply is provided outwardly of the cylinder ply. The cords extend longitudinally and have a high elastic modulus. A second fabric ply is provided outwardly of said rubber layer and a working surface is provided outwardly of this second fabric ply. The second fabric ply is a second transverse stiffening ply and also includes a plurality of transverse rods. The first and second fabric plies are both preferably comprised of woven cloth and the transverse rods are preferably substantially straight monofilament plastic fibers. Preferably the plastic is a polyester and the monofilaments have diameters of about 2 to about 35 mils. Preferably the printing blanket has a thickness between 50 and 75 mils.

The intermediate cord ply is preferably at about or near to the neutral plane providing a separation of the two transverse stiffening plies to opposite sides of the neutral plane. The continuous belt has properties of relative ease of bending in the machine direction and of relative resistance to bending across the cross machine direction provided by a material extending in the cross machine direction in two separated layers on either side of the neutral plane and spaced from the neutral plane. The multilayer belt has good stiffness against transverse collapse and folding. A method of printing is also provided which comprises affixing the material to be printed to the printing blanket.

BEST MODE

Figure 1:
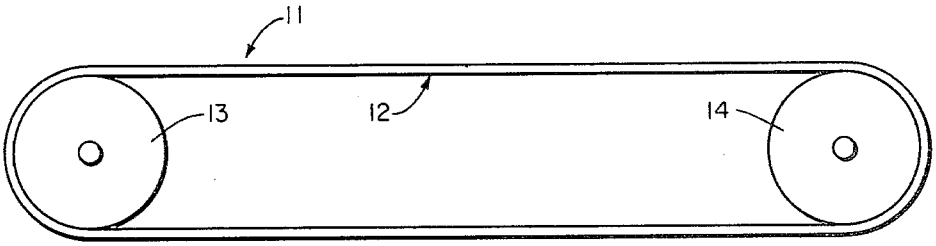
FIG. 1 is a side elevation schematic view of a blanket of the present invention mounted for operation over two rolls.

Referring to FIG. 1 a screen printing blanket 11 may be engaged over the cylinders or rolls 13 and 14 for operation in the manner well known in the screen printing industry. One of rolls 13 and 14 is usually powered to drive the blanket 11 through frictional engagement with the blanket 11.

Figure 2:
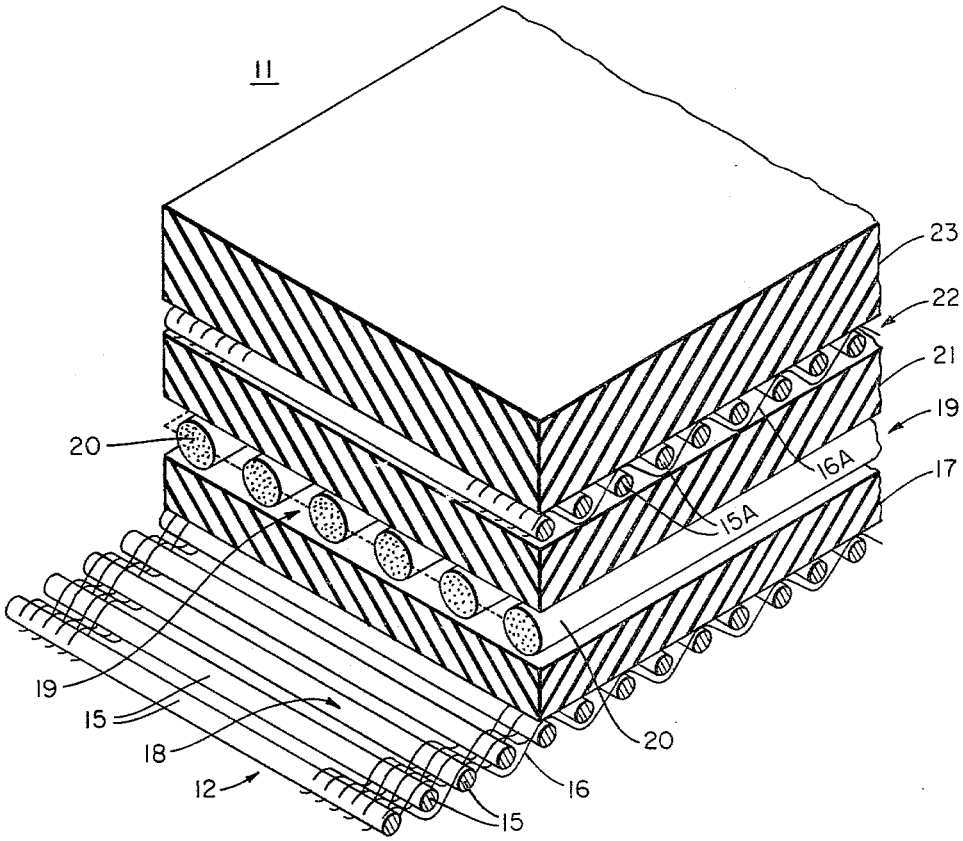
FIG. 2 is an enlarged schematic cut away sectional view.

Referring to FIG. 2, it may be seen that the cylinder ply 12 of blanket 11 contains transverse rods 15 joined into a woven cloth by fibers 16. The fibers or threads 16 extend in a perpendicular direction to the rods and curve over and under the rods to form the textile. Ply 12 is a transverse stiffening ply because it contains the transverse stiffening rods 15. A rubber coating 17 is present on outer face 18 of the cylinder ply, and serves as an adhesive layer. A layer 19 of inelastic cord 20 is laid over the rubber coating 17. This cord ply 19 is the longitudinal load bearing ply that provides the primary strength against longitudinal stretching. It has a high modulus of elasticity. A rubber coating 21 is present over the cord ply 19. Rubber coating 21 also serves as an adhesive layer.

A second transverse stiffening ply 22, containing transverse rods 15A joined into a woven cloth by threads 16A, overlies the rubber layer 21. A working surface of rubber 23 overlies the second transverse stiffening ply 22. The composite structure consisting of layers 12, 17, 19, 21, 22 and 23 is pressed and vulcanized into a unitary structure. Layers 17, 19 and 21 form an intermediate layer that separates the transverse stiffening plies 12 and 22.

The transverse rods may be of any material that is relatively stiff. Multifilament yarns impregnated with stiff resins such as phenolics or melamine and formed into monofilament-like structures and cured can be used. However, preferred rods are stiff plastic monofilament fibers. Glass, nylon, polypropylene and steel monofilaments may be used in some applications. However, by far the preferred rods, the only ones that are known to give outstanding results and provide economy in manufacture, are stiff polyester fibers and preferably polyethylene terephthalate monofilament fibers. Preferably the monofilaments have diameters of about 2 to about 35 mils more preferably about 5 to about 15 mils.

There are many reasons that have been demonstrated by me that show polyester fibers and particularly polyethylene terephthalate monofilaments are superior. One important, special property of these specific fibers is their good and surprising temperature expansion and contraction properties in concert with the rubbers used in the preferred intermediate ply, in particular the preferred nitrile and neoprene rubbers.

The rods are preferably joined into a cloth fabric as weft yarns by warp yarns which are more supple and less stiff. The warp yarns extend in the belts longitudinal or machine direction curving over and under the substantially straight and stiff monofilament fibers to form the textile. Preferably the warp yarns are of cotton.

The screen printing blanket preferably has a thickness of between about 50 and about 75 mils as contrasted to the usual standard screen printing blanket thickness of a little over 100 mils. The present blanket is not only thinner than the standard blanket, it has greater transverse stiffness and strength against transverse distortion, folding or collapsing.

The rubber coatings sufficiently impregnate the fabric to lock the transverse rods together further increasing the blankets cross width stiffness and rigidity.

Also provided by the present invention is a method of screen printing which involves affixing the material to be printed to the printing blanket of the present invention. Thereafter the blanket is moved through its normal steps and indicia is applied as desired. After completion of the printing procedure including any adjuct procedure the printed material is removed from the blanket.

The invention is further illustrated by the following Example.

EXAMPLE

For purposes of comparison four laminates were prepared in the lab and tested for transverse stiffness by cutting them into strips 1 inch by 4 inches with the 4 inches extending in the cross machine direction. The strips were tested on a Gurley stiffness tester, a product of Teledyne Gurley Company, Troy, N.Y.

The samples were prepared as follows. The cylinder ply of fabric was secured around a drum. This ply was provided with a layer of about 7 mils of nitrile rubber. Aramid (Kelvar® a product of DuPont) 1500 denier cord was circumferentially wound over the rubber so that there were about 18 cords per inch. About 2 mils of nitrile rubber was applied over the cord. Then a fabric having a 30 mil layer of nitrile rubber on one face and 2 mils of nitrile rubber on the other face was placed over the 2 mil coat of nitrile rubber applied to the cord with its 30 mil layer facing outwardly. This composite was then vulcanized in a press under heat and pressure.

The only difference in the four laminates was in the use of various combinations of fabrics in the fabric plys. Two types of fabric were used. One fabric was a woven broken twill textile or cloth having warps that were twisted cotton yarns 12/12 and wefts that were 10 mils diameter polyethylene terephthalate monofilaments (Trevira® 900 product of Hoechst Fibers Industries). The textile has 45 monofilament yarns per inch and 62 cotton ends per inch. This shall be identified as woven with rods. The other fabric was a plain weave cotton fabric. The plain weave cotton fabric was of 20/2 cotton yarn with 65 warp ends per inch and 54 weft yarns per inch. This shall be identified as cotton weave. The four samples can now be described as follows. All had the same 30 mil rubber working surface and all had the same rubber, cord, rubber intermediate layer. They all had the same general construction illustrated in FIG. 2 with the exception of the varient fabric used in plys 12 and 22. They had the cylinder ply, outer fabric ply, thickness and stiffness characteristics shown in the following table.

| | Cylinder Ply | Outer Fabric Ply | Thickness | CD* Stiffness mg/in |
|---|---|---|---|---|
| Sample 1 | woven w/rods | woven w/rods | 86 | 97,000 |
| Sample 2 | woven w/rods | cotton weave | 88 | 59,000 |
| Sample 3 | cotton weave | woven w/rods | 77 | 15,000 |
| Sample 4 | cotton weave | cotton weave | 77 | 12,000 |

*cross machine direction.

For the usual situation the ply providing the linear strength in the screen printing blanket also defines the general location of the neutral plane within the blanket. Therefore, for purposes of describing this invention they will be considered in this application by definition to be synonomous terms where such a linear strengthening layer or ply is present. Thus where only one such linear strengthening layer is clearly present the determinate of the neutral plane will by definition be this layer or ply. Where a linear strengthening layer is not present then the neutral plane must be determined according to the usual methods of physics.

It can be seen that both Samples 2 and 3 each contain 1 ply of the rods. When the rods are more distantly spaced from the neutral plane, below the plane and in particular at the cylinder ply they give a much higher transverse stiffening. Surprisingly when the rod ply of Samples 2 and 3 are combined as in Sample 1 the improvement is much more than additive. This is thought to be both because the rod plys are spaced apart and also because they are spaced across the neutral plane.

Now that the primary features of the preferred embodiment have been described it will be obvious that less preferred possibilities exist by simply substract features of my primary invention until the prior art embodiments are reached. By the same philosophy one can apply my invention to other belts than screening printing belts. As the Example illustrates the changing of the transverse stiffening ply overlying the netural zone to some other fabric is not nearly as deleterious to the primary practicing of my invention as is the changing of the cylinder ply.

While in accordance with the patent status, I have described what at present is considered to be the preferred embodiment of my invention, it will be obvious to those skilled in the art that numerous changes and modifications may be made therein without departing from the invention and it is therefore aimed in the appended claims to cover all such equivalent variations as fall within the true spirit and scope of the invention.

I claim:

1. A continuous belt screen printing blanket comprising a cylinder ply comprising a transverse stiffening fabric having a plurality of transverse rods with a plurality of longitudinal fibers woven over and under the transverse rods, a rubber layer outwardly of said cylinder ply and having a ply of longitudinally extending cord of high elastic modulus therein, an outer fabric ply outwardly of said rubber layer, and a screen printing working surface outwardly of said outer fabric ply.

2. The screen printing blanket of claim 1 wherein said outer fabric ply is a transverse stiffening fabric having a plurality of transverse rods.

3. The screen printing blanket of claim 2 wherein all of the rubbers used consist essentially of rubbers chosen from the group consisting of nitrile rubbers, neoprene rubbers and mixtures thereof; said transverse rods are substnatially straight monofilament plastic fibers comprised of polyester having diameters of about 2 to about 35 mils and said screen printing blanket thickness is about 50 to about 75 mils.

4. A continuous printing loop screen printing blanket comprising an intermediate ply having a high modulus of elasticity in the longitudinal direction, an inner ply comprising a transverse stiffened fabric having a plurality of transverse rods with a plurality of fibers extending in the longitudinal direction curving over and under the transverse rods, an outer ply comprising a transverse stiffened fabric having a plurality of transverse rods with a plurality of fibers extending in the longitudinal direction curving over and under the transverse rods, a working surface outwardly of said outer ply and a screen printed material glued to said working surface.

5. The screen printing blanket of claim 4 wherein said transverse rods are polyester monofilament weft yarns and said fibers are supple warp yarns.

6. The screen printing blanket of claim 4 wherein said intermediate ply contains a neutral plane of said continuous printing loop.

7. A printing blanket comprising a first ply having a plurality of substantially straight rods comprised of polyester and extending in a first linear direction and means for holding said rods in position in said ply, a second ply having a plurality of substantially straight rods comprised of polyester and extending in said first linear direction and means for holding said rods in position in said second ply, an intermediate spacing ply comprised of a rubber chosen from the group consisting of nitrile rubbers and neoprene rubbers and mixtures thereof and a printing blanket working surface.

8. The printing blanket of claim 7 wherein said intermediate ply includes fibers having a high modulus of elasticity extending perpendicular to said first linear direction.

9. The printing blanket of claim 7 wherein said rods are monofilament fibers woven into a textile with fibers extending in the perpendicular direction curving over and under to form the textile.

10. The printing blankets of claim 9 wherein said rods have diameters of about 2 to about 35 mils.

11. The printing blanket of claim 10 wherein said rods consist essentially of polyethylene terephthalate and have diameters of about 5 to about 15 mils.

12. The printing blanket of claim 7 in the form of a continuous belt wherein said intermediate ply contains the neutral plane of said continuous belt.

* * * * *